US007525401B2

(12) United States Patent
Abe et al.

(10) Patent No.: US 7,525,401 B2
(45) Date of Patent: Apr. 28, 2009

(54) STACKED FILTER

(75) Inventors: Toshiyuki Abe, Tokyo (JP); Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 51 days.

(21) Appl. No.: 11/902,615

(22) Filed: Sep. 24, 2007

(65) Prior Publication Data

US 2008/0079517 A1 Apr. 3, 2008

(30) Foreign Application Priority Data

Sep. 29, 2006 (JP) ..... 2006-268439

(51) Int. Cl.
*H01P 1/20* (2006.01)
*H01P 3/08* (2006.01)

(52) U.S. Cl. ..... 333/204; 333/202; 333/206

(58) Field of Classification Search ..... 333/202, 333/203, 204, 205, 206, 207
See application file for complete search history.

(56) References Cited

U.S. PATENT DOCUMENTS 5,066,933 A 11/1991 Komeda
5,248,949 A * 9/1993 Eguchi et al. ..... 333/204
5,373,271 A * 12/1994 Hirai et al. ..... 333/205
5,497,130 A * 3/1996 Hirai et al. ..... 333/204
5,576,672 A * 11/1996 Hirai et al. ..... 333/204
5,621,365 A * 4/1997 Yamazaki et al. ..... 333/204
6,304,156 B1 * 10/2001 Ishizaki et al. ..... 333/134
6,424,236 B1 * 7/2002 Kato ..... 333/185
6,470,173 B1 10/2002 Okada et al.
6,597,259 B1 * 7/2003 Peters ..... 333/134
6,784,762 B2 * 8/2004 Kato ..... 333/185
6,919,748 B2 * 7/2005 Lee et al. ..... 327/204
2006/0061438 A1 3/2006 Toncich
2006/0255885 A1 11/2006 Yoshikawa et al.

FOREIGN PATENT DOCUMENTS

EP 1 513 217 A1 3/2005
JP A-06-216605 8/1994
JP B2-3067612 5/2000

OTHER PUBLICATIONS

Mu Y et al: *A Novel Compact Interdigital Bandpass Filter Using Multilayer Cross-Coupled Folded Quarter-Wavelength Resonators, IEEE Microwave and Wireless Components Letters*; IEEE Service Center; New York; vol. 15; No. 12, Dec. 2005; pp. 847-849.

* cited by examiner

*Primary Examiner*—Benny Lee
*Assistant Examiner*—Kimberly E Glenn
(74) *Attorney, Agent, or Firm*—Oliff & Berridge, PLC

(57) ABSTRACT

A stacked filter includes an array of resonant sections, the resonant sections adjacent each other being electromagnetically coupled, a first resonator electromagnetically coupled to the resonant section on one end of the array of the resonant sections, and a second resonator electromagnetically coupled to the resonant section on the other end thereof. Each of the resonant sections has a pair of interdigital coupled quarter-wave resonators, and a passing frequency as a filter is set to a value $f_2$ lower than a frequency $f_0$ determined by a physical length $\lambda_0/4$ of the quarter-wave resonator. The first and second resonators have a physical length of $\lambda_2/4$, where $\lambda_2$ is a wavelength corresponding to the passing frequency $f_2$. The stacked filter enables miniaturization and sufficient impedance matching with external circuits in a broad band, resulting in excellent filter characteristics in the broad band.

4 Claims, 10 Drawing Sheets

1
4
2
3

X1
51B
51C
102
41A
21
22
23
24

5
5A 6
6A 101
31
32
33
34
51A
41C
41B
X2

1
4
2
3
X
Y
Z

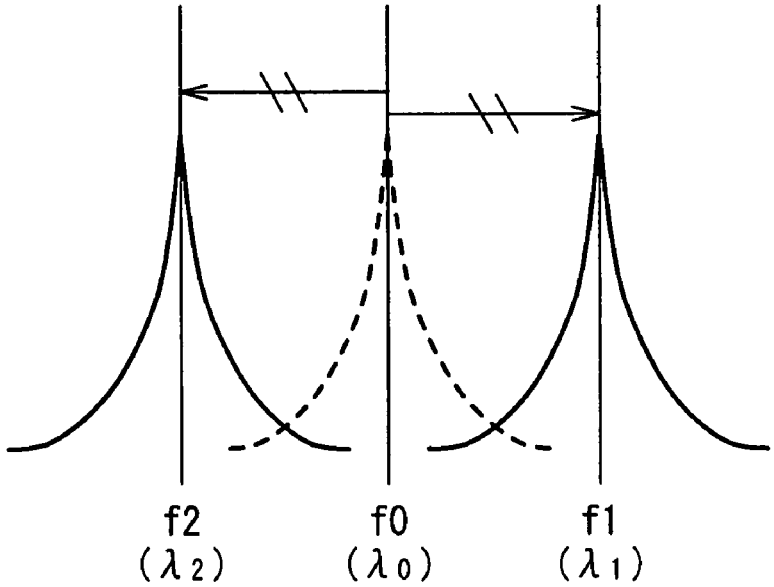
FIG. 10
FIG. 11A
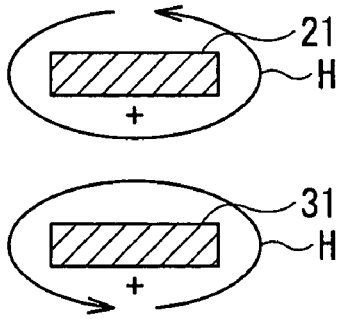
FIG. 11B
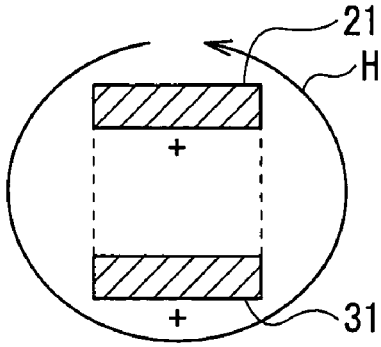

41C
RELATED ART
1
4
2

STACKED FILTER

BACKGROUND OF THE INVENTION

1. Field of the Invention

The present invention relates to a small stacked filter usable in radio communication equipments such as cellular (portable) phones.

2. Description of the Related Art

It has been known that resonators are formed by using strip conductors, and a plurality of these resonators are coupled to each other to configure a filter. For example, Japanese Unexamined Patent Application Publication No. 6-216605 discloses a strip line filter where resonators constructed of strip conductors are arranged in a plane direction and interdigital coupled to each other. Meanwhile, miniaturization and higher performance of radio communication equipments such as cellular phones are advanced in the recent years, and there is a demand for miniaturization of filters mounted thereon. The abovementioned strip line filter has difficulties in miniaturization because the resonators are planarly configured. As a filter advantageous in miniaturization, there is, for example, a stacked filter where conductors for resonators are stacked in the inside of a dielectric substrate, as disclosed in Japanese Patent No. 3067612.

SUMMARY OF THE INVENTION

In the stacked filters, the use of interdigital type resonators is advantageous in the interests of miniaturization. For example, the following technique can be considered. That is, conductors for a resonator are arranged in a stacking direction in a stacked substrate and then strongly interdigital coupled to each other in the stacking direction, thereby generating two operation modes. By operating in one mode having a lower frequency than the other, the physical length of the resonator can be reduced with respect to the operation frequency, thereby miniaturizing the filter. When the filter of this structure is connected to an external circuit, the impedance of a resonator connected becomes higher as the physical length of the resonator is larger. The impedance also becomes higher as the permittivity in the stacked substrate is smaller and the degree of capacitive coupling of the resonator is smaller. On the contrary, a small physical length of the resonator and a large degree of capacitive coupling of the resonator are advantageous in the interests of miniaturization of the stacked filter. Consequently, when an attempt is made to miniaturize the stacked filter, the impedance of the resonator may be lowered, and the impedance matching with the external circuit cannot be obtained in the passing band of the filter, failing to obtain sufficient filter characteristics. This is the primary problem when widening the band.

It is desirable to provide a stacked filter enabling miniaturization and sufficient impedance matching with external circuits in a broad band, resulting in excellent filter characteristics in the broad band.

The stacked filter of an embodiment of the invention includes: an array of more than two resonant sections arranged parallel in a stack plane direction, the resonant sections adjacent each other being electromagnetically coupled; a first resonator electromagnetically coupled to the resonant section on one end of the array of the resonant sections, and a second resonator electromagnetically coupled to the resonant section on the other side thereof. Each of the resonant sections has a plurality of quarter-wave resonators facing each other in a stacking direction, and the quarter-wave resonators facing each other are interdigital coupled to each other, so that a passing frequency as a filter is set to a value $f_2$ lower than a frequency $f_0$ determined by a physical length $\lambda_0/4$ in each of the quarter-wave resonator, and the first and second resonators have a physical length of $\lambda_2/4$, where $\lambda_2$ is a wavelength corresponding to the passing frequency $f_2$.

In the description of the present invention, the term "a pair of interdigital coupled quarter-wave resonators" means resonators electromagnetically coupled to each other by arranging so that the open end of a first quarter-wave resonator is faced to the short-circuit end of a second quarter-wave resonator, and the short-circuit end of the first quarter-wave resonator is faced to the open end of the second quarter-wave resonator.

According to the stacked filter of the embodiment of the invention, miniaturization can be facilitated by configuring the adjacent quarter-wave resonators as a pair of interdigital coupled quarter-wave resonators in the respective resonant sections. When a pair of quarter-wave resonators are of interdigital type and strongly coupled to each other, there appear first and second resonance modes with respect to a resonance frequency $f_0$ determined by a physical quarter-wave length $\lambda_0/4$ (i.e. a resonance frequency in each of the quarter wave resonators when no interdigital coupling is established). That is, the first resonance mode resonates at a first resonance frequency $f_1$ higher than the resonance frequency $f_0$. The second resonance mode resonates at a second resonance frequency $f_2$ lower than the resonance frequency $f_0$. The resonance frequency is then divided into two. In this case, by setting, as a passing frequency (an operating frequency) as a filter, the second resonance frequency $f_2$ lower than the resonance frequency $f_0$ corresponding to the physical length $\lambda_0/4$, miniaturization can be facilitated than the case of setting the passing frequency to the resonance frequency $f_0$. In the second resonance mode having a lower frequency, a current i flows in the same direction to each resonator, and the conductor thickness can be increased artificially, thereby reducing the conductor loss.

Further, the first and second resonators having a physical length of $\lambda_2/4$ are electromagnetically coupled to the resonant sections at the opposite ends of the array of the two or more resonant sections having the above-mentioned interdigital coupling structure, respectively. Since $\lambda_2$ is a wavelength corresponding to the passing frequency $f_2$, the physical length $\lambda_2/4$ of the first and second resonators is longer than the physical length $\lambda_0/4$ of the pair of interdigital coupled quarter-wave resonators. Hence, the first and second resonators have higher impedance than the resonant sections having the interdigital coupling structure, and therefore it is easy to obtain impedance matching with external circuits in a broad band. This achieves miniaturization as the entire filter, and also provides excellent filter characteristics in the broad band.

Preferably, each of the first and second resonators has a plurality of line conductors arranged in the stacking direction and a connection conductor completing continuity between the plurality of line conductors. Alternatively, a whole length of the line conductors and the connection conductor may be a length of $\lambda_2/4$.

With this configuration, the line conductors constituting the first and second resonators can be formed separately in the stacking direction, permitting a reduction of the length of the line conductors in the respective stack plane. This is advantageous in miniaturization.

Preferably, there is further provided with a couple of leading conductors each causing the first or second resonator to be in continuity with an external terminal electrode.

Preferably, each of the first and second resonators has one end as an open end and the other end as a short-circuit end, the open end of the first resonator and the open end of the second resonator being oriented in reverse direction.

In cases where the open end of the first resonator and the open end of the second resonator are oriented in the same direction, the signal input to and the signal output from the first and second resonators may cause unnecessary pass at the open ends in the first and second resonators. That is, by oppositely orienting the open ends of the first and second resonators, the unnecessary pass can be suppressed to provide more excellent filter characteristics. In particular, attenuation poles can be generated beyond the passing frequency band. This is advantageous in improving attenuation characteristics.

Thus, firstly, the miniaturization can be facilitated in the point that the respective resonant sections are constructed of the plurality of stacked interdigital coupled quarter-wave resonators. Secondly, the first and the second resonators are arranged adjacent the resonant sections at the opposite ends, respectively, so that the physical length thereof can be longer than that of the plurality of interdigital coupled quarter-wave resonators. This enables the first and second resonators to have higher impedance than the resonant sections having the interdigital coupling structure, making it easy to obtain impedance matching with the external circuits in the broad band. These enable miniaturization and sufficient impedance matching with the external circuits in the broad band, resulting in excellent filter characteristics in the broad band.

Other and further objects, features and advantages of the invention will appear more fully from the following description.

BRIEF DESCRIPTION OF THE DRAWINGS

FIG. 10 is an explanatory drawing illustrating a distribution state of resonance frequency in a pair of interdigital coupled quarter-wave resonators;

FIGS. 11A and 11B are a first explanatory drawing and a second explanatory drawing, illustrating a field distribution in the pair of interdigital coupled quarter-wave resonators, respectively;

DESCRIPTION OF THE PREFERRED EMBODIMENTS

Preferred embodiments of the present invention will now be described in detail with reference to the accompanying drawings.

Figure 1:
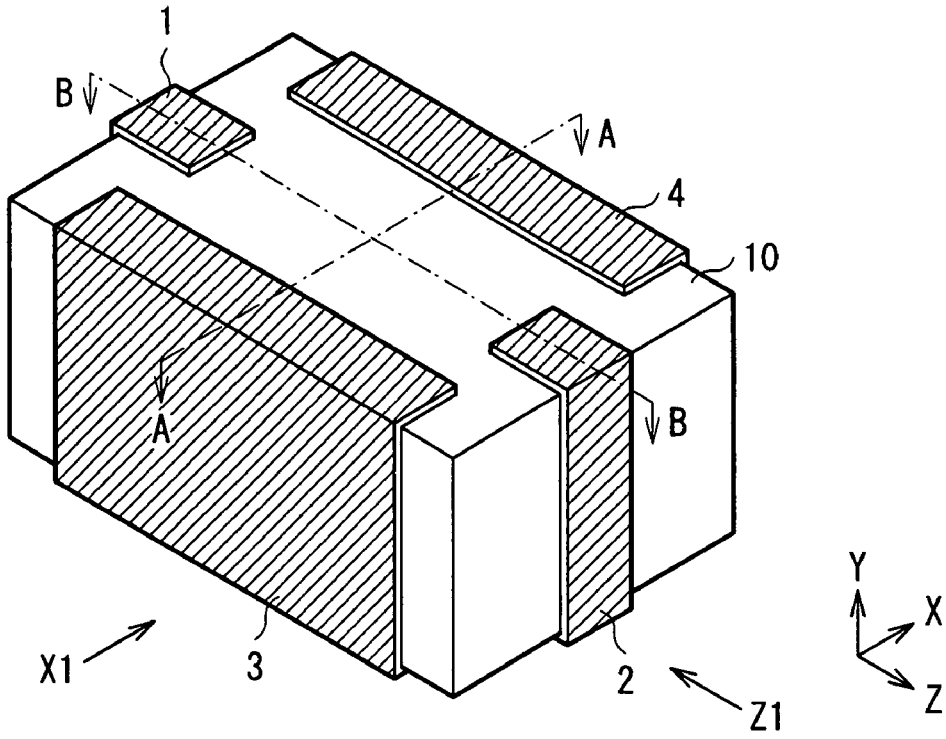
FIG. 1 is a perspective view illustrating the overall configuration of a stacked filter according to a preferred embodiment of the present invention.
Figure 2:
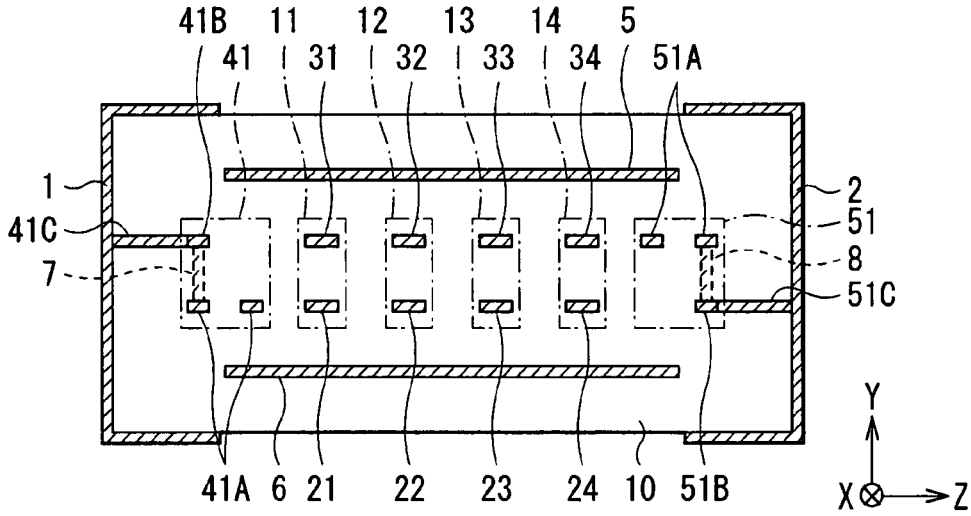
FIG. 2 is a sectional view illustrating a cross-section of the stacked filter in the preferred embodiment.
Figure 3:
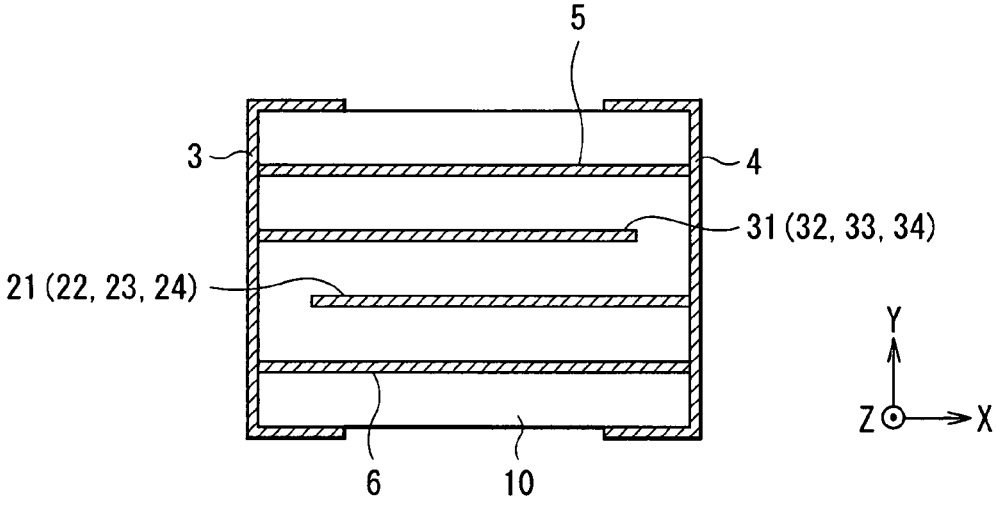
FIG. 3 is a sectional view illustrating other cross-section of the stacked filter in the preferred embodiment.

FIG. 1 illustrates an example of the configuration of a stacked filter according to a preferred embodiment of the present invention. FIG. 2 illustrates the cross-sectional configuration of the stacked filter viewed from the X1 direction, taking along the YZ plane including the B-B line in FIG. 1. FIG. 3 illustrates the cross-sectional configuration of the stacked filter taken along the YX plane including the A-A line in FIG. 1. FIGS. 4A to 4F illustrate a stack plane configuration in individual layers of the stacked filter, respectively. Below the uppermost layer of FIG. 4A, the layers of FIGS. 4B, 4C, 4D, 4E, and 4F as the lowermost layer, are stacked in the order named.

Figure 5:
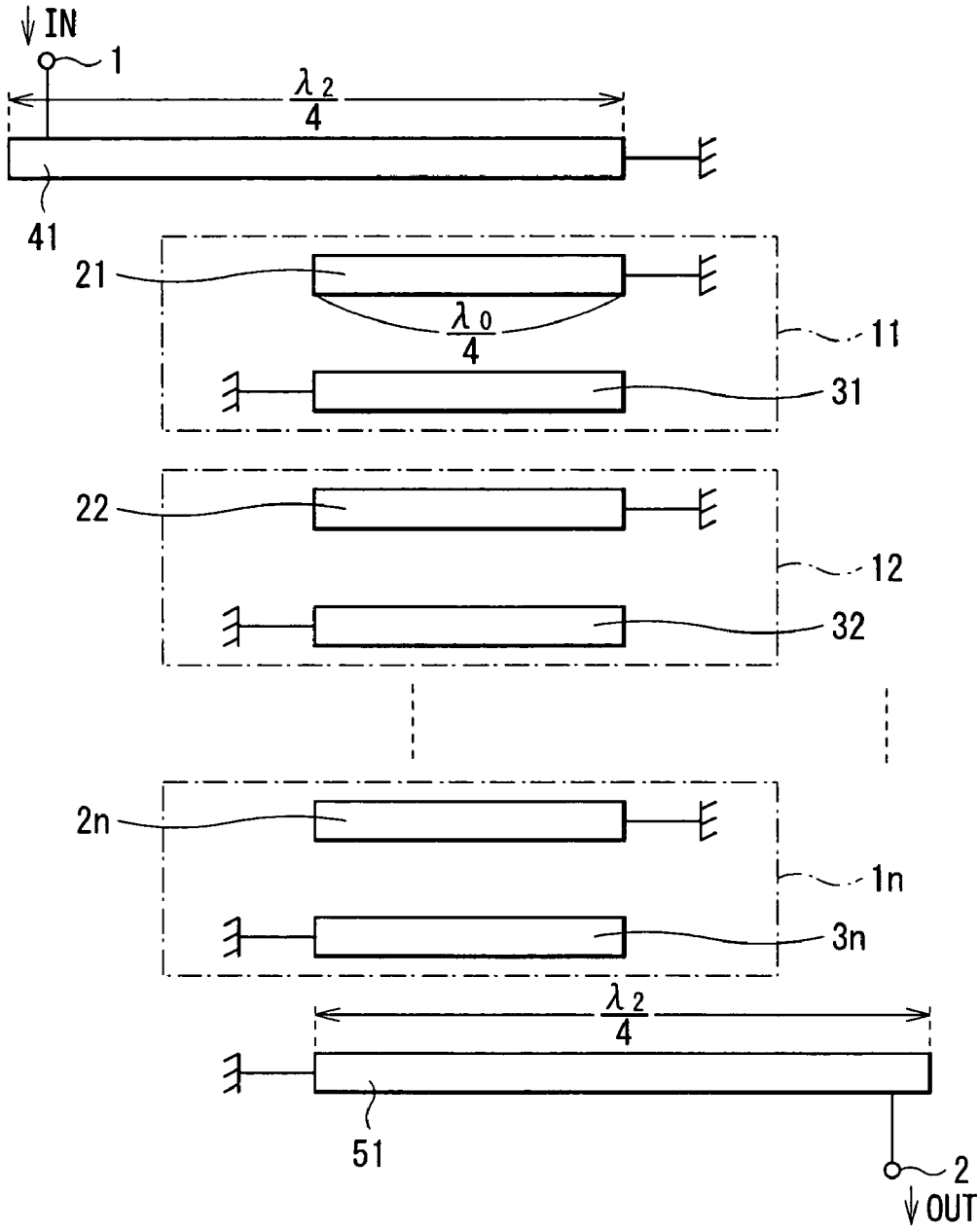
FIG. 5 is a schematic diagram illustrating the basic configuration of the stacked filter in the preferred embodiment.

First, the basic resonance structure of the stacked filter will be described with reference to FIG. 5. The present embodiment describes an unbalanced input/unbalanced output filter having unbalanced terminals on input and output terminals thereof, respectively. The stacked filter includes an array of n (n is 2 or more) resonant sections 11, 12, . . . 1*n*, the adjacent ones being electromagnetically coupled to each other; a first resonator 41 electromagnetically coupled to the resonant section 11 on one end of the array of these resonant sections 11, 12, . . . 1*n*, and a second resonator 51 electromagnetically coupled to the resonant section in on the other end side thereof. A first external terminal electrode 1 for signals, which becomes one unbalanced terminal, is connected to the first resonator 41. A second external terminal electrode 2 for signals, which becomes the other unbalanced terminal, is connected to the second resonator 51. An external circuit such as an IC (not shown) is connected to the first external terminal electrode 1 for signals or the second external terminal 2 for signals. This filter can serve as an unbalanced input/unbalanced output filter as a whole, by using, for example, the first external terminal electrode 1 for signals as an input terminal, and the second external terminal electrode 2 for signals as an output terminal.

The resonant section 11 has two quarter-wave resonators 21 and 31. Similarly, other resonators 12, . . . 1*n* have two quarter-wave resonators 22, 2*n*, and 32, . . . 3*n*, respectively. The corresponding two quarter-wave resonators 21, 22, . . . 2*n*, and 31, 32, 3*n* in the array of the resonant sections 11, 12, . . . 1*n* are interdigital coupled to each other.

Here, the concept of interdigital coupling will be described by exemplifying the resonant section 11 on one end. The interdigital coupling means that a pair of quarter-wave resonators 21 and 31 are electromagnetically coupled by employing one ends of these resonators 21 and 31 as open ends, and the other ends as short-circuit ends, respectively, and by arranging so that the open end of the resonator 21 is faced to the short-circuit end of the resonator 31, and the short-circuit end of the resonator 21 is faced to the open end of the resonator 31.

In the present embodiment, the pair of quarter-wave resonators 21 and 31 are strongly interdigital coupled at the time of resonance, as will be described later. Therefore, these resonators 21 and 31 have a first resonance mode that resonates at a first resonance frequency $f_1$, and a second resonance mode that resonates at a second resonance frequency $f_2$ lower than the first resonance frequency $f_1$. More specifically, these have the first resonance frequency $f_1$ higher than a resonance frequency $f_0$, and the second resonance frequency $f_2$ lower than the resonance frequency $f_0$, where $f_0$ is a resonance frequency in each of these quarter-wave resonators 21 and 31 when no interdigital coupling is established. It is configured so that the operating frequency becomes the second resonance frequency $f_2$.

Similarly, other resonant sections 12, . . . 1*n* have the interdigital coupling structure. The stacked filter establishes electromagnetic coupling by the resonance of the adjacent resonant sections at the second resonance frequency $f_2$ of the lower frequency. This results in a band pass filter as a whole, using the second resonance frequency $f_2$ as a passing frequency. That is, the passing frequency of the filter is set to the value $f_2$ lower than the frequency $f_0$ determined by the physical length $\lambda_0/4$ of each quarter-wave resonator in each resonant section.

The first resonator 41 has its physical length of $\lambda_2/4$, where $\lambda_2$ is a wavelength corresponding to the passing frequency $f_2$. The same is true for the second resonator 51. That is, the first and second resonators 41 and 51 are quarter-wave resonators having a length ($\lambda_2/4$) greater than the length ($\lambda_0/4$) of the quarter-wave resonator in the resonant sections 11, 12, . . . 1*n*.

Next, a specific structure of the stacked filter will be described with reference to FIGS. 1 to 3 and FIGS. 4A to 4F. In these drawings, those parts corresponding to the basic configuration of FIG. 5 are identified with the same numerals. This example shows a stacked filter provided with four resonant sections 11, 12, 13 and 14 (when n is 4).

The stacked filter has a dielectric block 10 shaped like substantially a rectangular parallelepiped as a whole, as shown in FIG. 1. External terminal electrodes 1 and 2 for signals are formed on first opposite side surfaces of the dielectric block 10. These electrodes 1 and 2 extend to the top and bottom surfaces. External terminal electrodes 3 and 4 for ground are formed on second opposite side surfaces of the dielectric block 10. These electrodes 3 and 4 extend to the top and bottom surfaces.

Conductor patterns as shown in FIGS. 4B to 4E are formed as internal layers in the inside of the dielectric block 10. These internal layers are stacked under the structure as shown in FIGS. 2 and 3. For example, this structure can be obtained by a stacked structure, namely stacking in sequence individual sheet-shaped dielectric substrates, each having a predetermined pattern on the surface thereof. The stacked filter has, as internal layers, shield electrode layers (FIGS. 4B and 4E) provided with shield electrodes 5 and 6, respectively, and line conductor layers (FIGS. 4C and 4D) provided with line conductors for constructing the resonant sections 11, 12, 13 and 14, and the first and second resonators 41 and 51, respectively.

The shield electrodes 5 and 6 are stacked vertically with the line conductor layer in between. In the upper shield electrode 5, a region 5A on the top surface, corresponding to the external terminal electrodes 1 and 2 for signals, is recessed (refer to FIGS. 4A and 4B). Similarly, in the lower shield electrode 6, a region 6A on the bottom surface, corresponding to the external terminal electrodes 1 and 2 for signals, is recessed (refer to FIGS. 4E and 4F). These recessed regions 5A and 6A are provided to avoid that unnecessary capacity components are generated in the stacking direction, between the shield electrodes 5 and 6 and the external terminal electrodes 1 and 2 for signals.

Figures 4A, 4B, 4C, 4D, 4E, 4F:
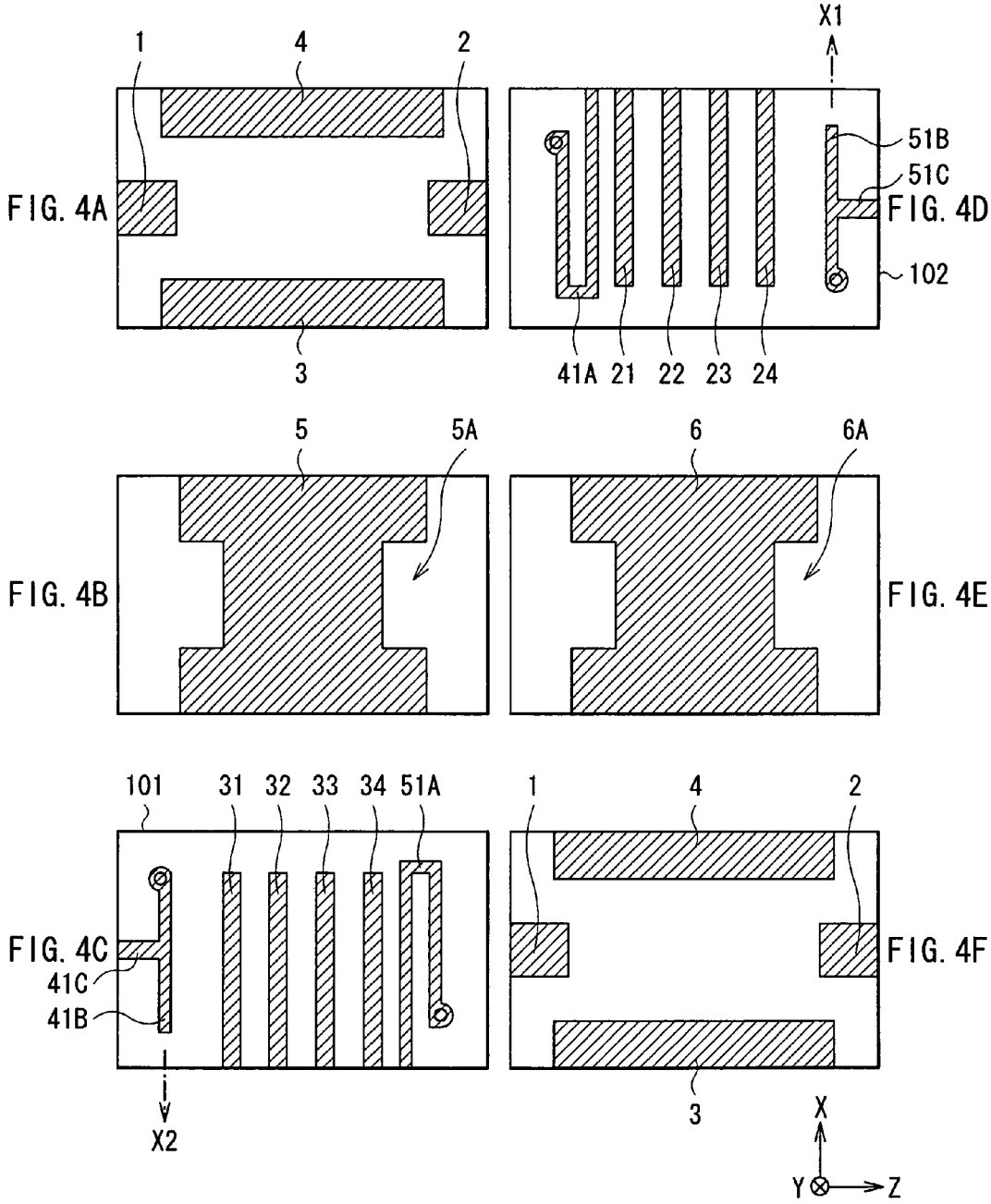
FIGS. 4A to 4F are diagrams illustrating the plane configurations of individual layers of the stacked filter in the preferred embodiment, respectively.

As the components of the resonant sections 11, 12, 13 and 14, a first group of the quarter-wave resonators 21, 22, 23 and 24, and a second group of the quarter-wave resonators 31, 32, 33 and 34 are formed as line patterns (strip lines) of the conductor. These line patterns have a length of $\lambda_0/4$, as above described. All of the quarter-wave resonators 21, 22, 23 and 24 in the first group are formed in a stacked surface 102 (FIG. 4D). Their respective first ends become short-circuit ends as being connected to the external terminal electrode 4 for ground, and their respective second ends are open ends, as shown in FIG. 3. All of the quarter-wave resonators 31, 32, 33 and 34 in the second group are formed in a stacked surface 101 (FIG. 4C). Their respective first ends become short-circuit ends as being connected to the external terminal electrode 3 for ground, and their respective second ends are open ends, as shown in FIG. 3. The stacked surfaces 101 and 102 are disposed adjacent each other in face-to-face relationship. This establishes the interdigital coupling in the stacking direction between the resonators 21, 22, 23 and 24 in the first group, and resonators 31, 32, 33 and 34 in the second group. This also produces the structure that the respective resonant sections 11, 12, 13 and 14 are arranged parallel in the stack plane direction.

The first resonator 41 is constructed of a line conductor 41A (FIG. 4D) formed on the stacked surface 102, a line conductor 41B (FIG. 4C) formed on the stacked surface 101, and a feed-through conductor 7 (FIG. 2) as a connection conductor completing continuity between the line conductors 41A and 41B. The first resonator 41, including these line conductors 41A and 41B and the feed-through conductor 7, has a length of $\lambda_2/4$, as a whole. The line conductor 41A is formed adjacent the quarter-wave resonator 21 constituting the resonant section 11 on the first end side in the stacked surface 102. The line conductor 41B is formed adjacent the quarter-wave resonator 31 on the second end side in the stacked surface 101. One end of the line conductor 41A is a short-circuit end as being connected to the external terminal electrode 4 for ground, and the other end is connected to the feed-through conductor 7. One end of the line conductor 41B is connected to the feed-through conductor 7, and the other end is the open end. Thus, the line conductors 41A, 41B and the feed-through conductor 7 configure, as a whole, the quarter-wave resonator having a length of $\lambda_2/4$, one end of which is the short-circuit end and the other end is the open end.

Similarly, the second resonator 51 is constructed of a line conductor 51A (FIG. 4C) formed on the stacked surface 101, a line conductor 51B (FIG. 4D) formed on the stacked surface 102, and a feed-through conductor 8 (FIG. 2) as a connection conductor completing continuity between the line conductors 51A and 51B. The second resonator 51, including these line conductors 51A and 51B and the feed-through conductor 8, has a length of $\lambda_2/4$, as a whole. The line conductor 51A is formed adjacent the quarter-wave resonator 34 constituting the resonant section 14 on the stacked surface 101. The line conductor 51B is formed adjacent the quarter-wave resonator 24 on the stacked surface 102. One end of the line conductor 51A is a short-circuit end connected to the external terminal electrode 3 for ground, and the other end is connected to the feed-through conductor 8. One end of the line conductor 51B is connected to the feed-through conductor 8, and the other end is the open end. Thus, the line conductors 51A, 51B and the feed-through conductor 8 configure, as a whole, the quarter-wave resonator having a length of $\lambda_2/4$, one end of which is the short-circuit end and the other end is the open end.

The line conductor 41B constituting the open end of the first resonator 41 is in continuity with one end of a leading conductor 41C formed on the stacked surface 101. The other end of the leading conductor 41C is in continuity with the first external terminal electrode 1 in the direction of the side surface. Thus, the first resonator 41 is brought into continuity with the first external terminal electrode 1 from the stacked surface 101, through the leading conductor 41C. The line conductor 51B constituting the open end side of the second resonator 51 is in continuity with one end of a leading conductor 51C formed on the stacked surface 102. The other end of the leading conductor 51C is in continuity with the second external terminal electrode 2 in the direction of the side surface. Thus, the second resonator 51 is brought into continuity with the second external terminal electrode 2 from the stacked surface 102, through the leading conductor 51C. Accordingly, in the stacked filter, the first and second resonators 41 and 51 are connected to the external terminal electrodes 1 and 2 from different inside layer sides, respectively.

Further, the stacked filter is configured so that the open end of the first resonator 41 and the open end of the second resonator 51 are oriented in the reverse direction. Specifically, the other end of the line conductor 41B, as the open end of the first resonator 41, is oriented in the X2 direction as shown in FIG. 4C, and the other end of the line conductor 51B as the open end of the second resonator 51 is oriented in the X1 direction as the reverse of the X2 direction, as shown in FIG. 4D.

Next, the operation of the stacked filter according to the present embodiment will be described.

In this filter, mainly by the resonant sections 11, 12, 13 and 14 functioning as resonators, an unbalanced signal inputted from the first external terminal electrode 1 for signals is filtered by using the second resonance frequency $f_2$ as a passing band, and then outputted from the second external terminal electrode 2 for signals.

The stacked filter enables miniaturization by configuring the respective resonant sections 11, 12, 13 and 14 as a pair of interdigital coupled quarter-wave resonators, and by using, as a passing band, the second resonance frequency $f_2$ having a lower frequency in the pair of interdigital coupled quarter-wave resonators. When the pair of quarter-wave resonators are of interdigital type and strongly coupled to each other as shown in FIG. 10 that will be described later, there appear first and second resonance modes with respect to a resonance frequency $f_0$ in each of the quarter wave resonators when no interdigital coupling is established (i.e. a resonance frequency determined by the physical quarter-wave length $\lambda_0/4$). That is, the first resonance mode resonates at a first resonance frequency $f_1$ higher than the resonance frequency $f_0$. The second resonance mode resonates at a second resonance frequency $f_2$ lower than the resonance frequency $f_0$. The resonance frequency is then divided into two. In this case, by setting, as an operating frequency as a resonator, the second resonance frequency $f_2$ lower than the resonance frequency $f_0$ corresponding to the physical length ($\lambda_0/4$), miniaturization can be facilitated than the case of setting the operating frequency to the resonance frequency $f_0$.

In the present embodiment, the first and second resonators 41 and 51 having a physical length of $\lambda_2/4$ are electromagnetically coupled to the resonant sections 11 and 14 at the opposite ends of the array of the plurality of resonant sections 11, 12, 13 and 14 having the abovementioned interdigital coupling structure, respectively. Since $\lambda_2$ is a wavelength corresponding to the passing frequency $f_2$, the physical length $\lambda_2/4$ of the first and second resonators 41 and 51 is longer than the physical length $\lambda_0/4$ of the pair of interdigital coupled quarter-wave resonators in the plurality of resonant sections 11, 12, 13 and 14. Hence, the first and second resonators 41 and 51 have higher impedance than the resonant sections 11, 12, 13 and 14 having the interdigital coupling structure, and therefore it is easy to obtain impedance matching with the external circuits in a broad band. This enables miniaturization as the entire filter, and also provides excellent filter characteristics in the broad band.

The line conductor constituting the first and second resonators 41 and 51 are formed separately in the stacking direction, permitting a reduction of the line conductor length in each stack plane. This is advantageous in miniaturization.

Further, the open end of the first resonator 41 and the open end of the second resonator 51 are formed in different layers, and oriented in reverse direction. This provides filter characteristics superior to that when these open ends are oriented in the same direction. In cases where the open end of the first resonator 41 and the open end of the second resonator 51 are oriented in the same direction, the signal input to and the signal output from the first and second resonators 41 and 51 may cause unnecessary pass at the open ends in the first and second resonators 41 and 51. That is, by arranging the open ends of the first and second resonators 41 and 51 in reverse direction, the unnecessary pass can be suppressed to provide more excellent filter characteristics. In particular, attenuation poles can be generated beyond the passing frequency band. This is advantageous in improving attenuation characteristics.

Figure 12:
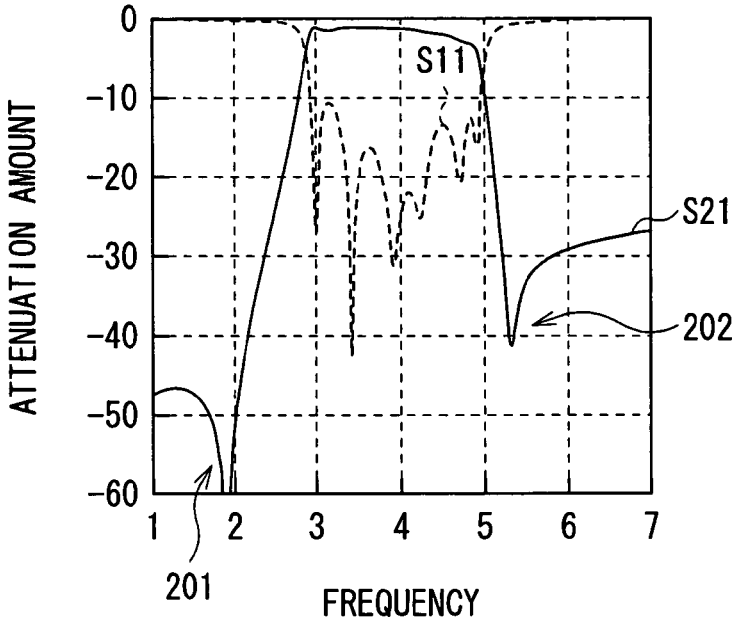
FIG. 12 is a characteristics chart showing the transmission characteristics of the stacked filter in the preferred embodiment.

The attenuation characteristics and loss characteristics of the stacked filter are shown in FIG. 12, on which the abscissa represents frequency and the ordinate represents attenuation amount. In FIG. 12, the curve indicated by reference numeral S21 represents the passing loss characteristics of signals in the stacked filter, and the curve indicated by reference numeral S11 represents the reflection loss characteristics when viewed from the input terminal (the external terminal electrode 1 for signals). It will be noted from FIG. 12 that excellent attenuation characteristics and loss characteristics are obtained in a broad band, and attenuations poles 201 and 202 are generated beyond the passing frequency band.

Figure 13:
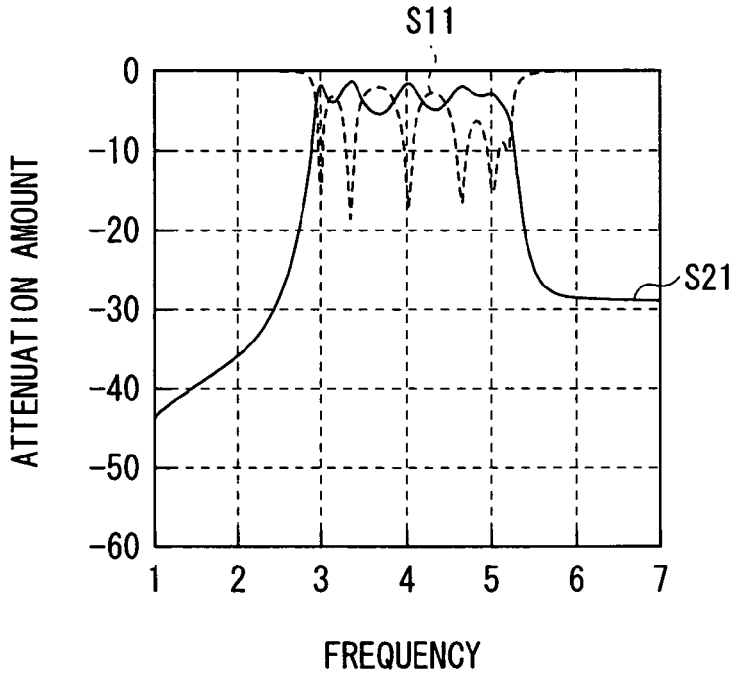
FIG. 13 RELATED ART
FIG. 13 is a characteristics chart showing the transmission characteristics of a stacked filter of a comparative example.

On the other hand, FIG. 13 shows the attenuation characteristics and loss characteristics in the structure of a stacked filter as a comparative example of the present embodiment. The internal structure of the stacked filter of the comparative example are illustrated in FIGS. 16A to 16F, in which those parts corresponding to the stacked filter of the present embodiment as illustrated in FIGS. 4A to 4F are identified with the same numerals. The stacked filter of the comparative example has quarter-wave resonators 21, 22, 23, 24, 25 and 26, and quarter-wave resonators 31, 32, 33, 34, 35 and 36, which constitute six resonant sections 11, 12, 13, 14, and 16. This filter is not provided with the first and second resonators 41 and 51 in the present embodiment, and leading conductors 41C and 51C are directly connected to the quarter-wave resonators 31 and 36 constituting the resonant sections 11 and 16 at the opposite ends, respectively. In the structure of the comparative example, the open ends of the quarter-wave resonators 31 and 36, to which the leading conductors 41C and 51C are connected respectively, are oriented in the same direction.

It will be noted from FIG. 13 that the structure of the comparative example not provided with the first and second resonators 41 and 51 is particularly inferior to the structure of the present embodiment in the reflection loss characteristics in the passing frequency band. Additionally, neither the attenuation pole 201 nor 202 as observed in the present embodiment is formed beyond the passing frequency band. That is, the comparative example is also inferior to the present embodiment in passing loss characteristics.

The following is a more detailed description of the operation and effect attainable under the interdigital coupling structure of the resonant sections 11, 12, 13 and 14. As a technique for coupling two resonators constructed of TEM (transverse electro magnetic) line, there are, for example, the following two types, namely comb-line coupling and interdigital coupling. It is known that interdigital coupling produces extremely strong coupling.

Figure 6:
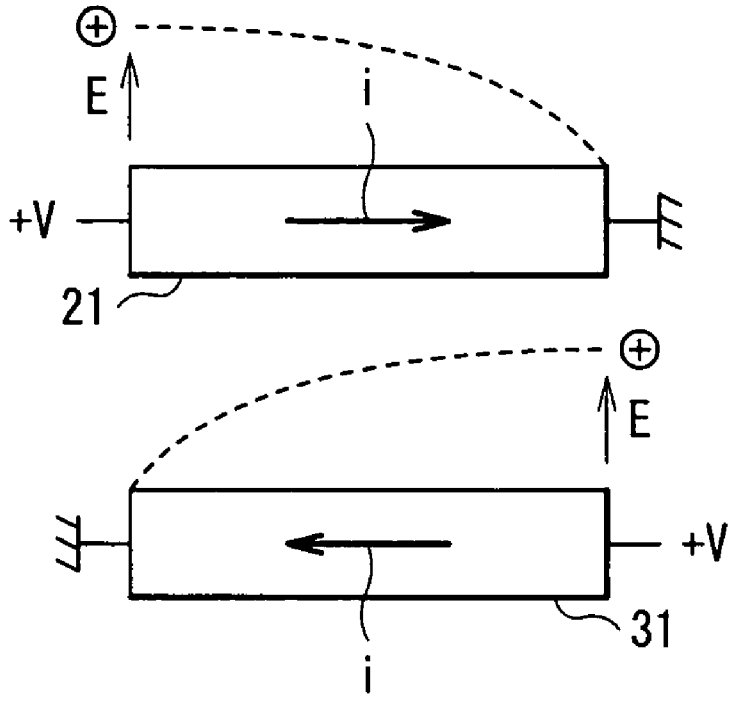
FIG. 6 is an explanatory drawing illustrating a first resonance mode of a pair of interdigital coupled quarter-wave resonators.
Figure 7:
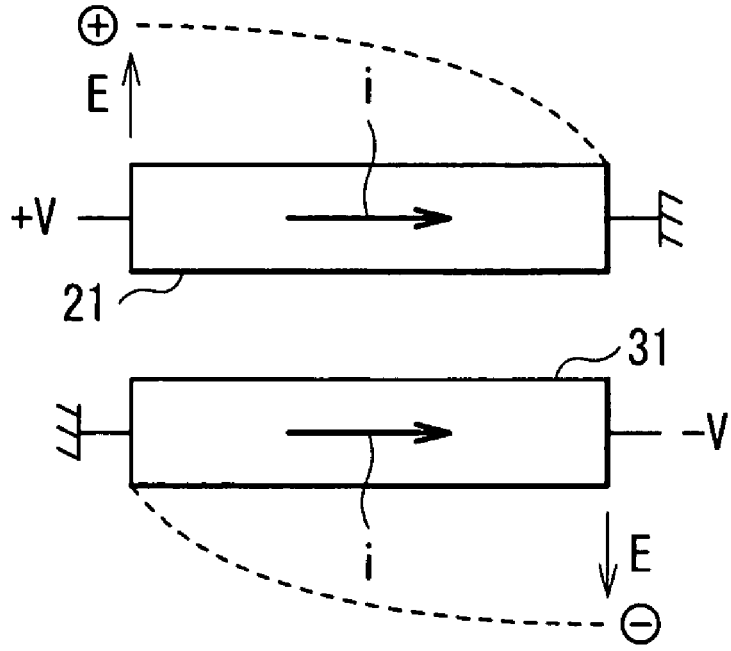
FIG. 7 is an explanatory drawing illustrating a second resonance mode of the pair of interdigital coupled quarter-wave resonators.

In the pair of interdigital coupled quarter-wave resonators 21 and 31, its resonance state can be divided into two inherent resonance modes. FIG. 6 illustrates a first resonance mode in the pair of interdigital coupled quarter-wave resonators 21 and 31. FIG. 7 illustrates a second resonance mode thereof. In FIGS. 6 and 7, the curves represented by the broken line illustrate distributions of an electric field E in the respective resonators. FIGS. 6 and 7 also illustrate the state of resonance of the pair of quarter-wave resonators 21 and 31, in which the other end is grounded. This means a zero potential in alternating current.

In the first resonance mode, a current i flows from the open end to the short-circuit end in the pair of quarter-wave resonators 21 and 31, respectively, and the currents i passing through these resonators reverse in direction. In the first resonance mode, an electromagnetic wave is excited in the same phase by the pair of quarter-wave resonators 21 and 31.

On the other hand, in the second resonance mode, the current i flows from the open end to the short-circuit end in one quarter-wave resonator 21, and the current i flows from the short-circuit end to the open end in the other the quarter-wave resonator 31, so that the currents i passing through these resonators flow in the same direction. That is, in the second resonance mode, an electromagnetic wave is excited in phase opposition by the pair of quarter-wave resonators 21 and 31, as can be seen from the distribution of the electric field E. In the second resonance mode, the phase of the electric field E is shifted 180 degrees at such positions as to be mutually rotation symmetry with respect to a physical axis of rotation symmetry, as a whole of the pair of quarter-wave resonators.

In the case of the structure of rotation symmetry, the resonance frequency of the first resonance mode can be expressed by $f_1$ in the following equation (1A), and the resonance frequency of the second resonance mode can be expressed by $f_2$ in the following equation (1B).

$$\begin{cases} f_1 = \dfrac{c}{\pi\sqrt{\varepsilon_r l}}\tan^{-1}\left(\sqrt{\dfrac{Z_e}{Z_o}}\right) & \text{(1A)} \\ f_2 = \dfrac{c}{\pi\sqrt{\varepsilon_r l}}\tan^{-1}\left(\sqrt{\dfrac{Z_o}{Z_e}}\right) & \text{(1B)} \end{cases}$$

where c is a light velocity; $\in_r$ is an effective relative permittivity; l is a resonator length; $Z_e$ is a characteristic impedance of an even mode; and $Z_o$ is a characteristic impedance of an odd mode.

In a coupling transmission line of bilateral symmetry, a transmission mode for propagating to the transmission line can be decomposed into two independent modes of an even mode and an odd mode (these do not interfere with each other).

Figure 8A:
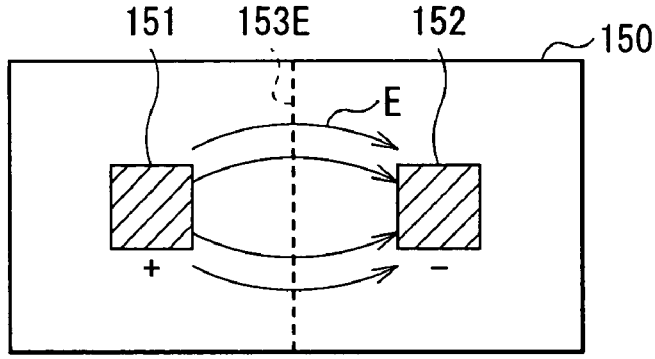
FIGS. 8A and 8B are explanatory drawings illustrating an electric field distribution in an odd mode in transmission modes of a coupling transmission line of bilateral symmetry, and an electric field distribution in an even mode, respectively.
Figure 8B:
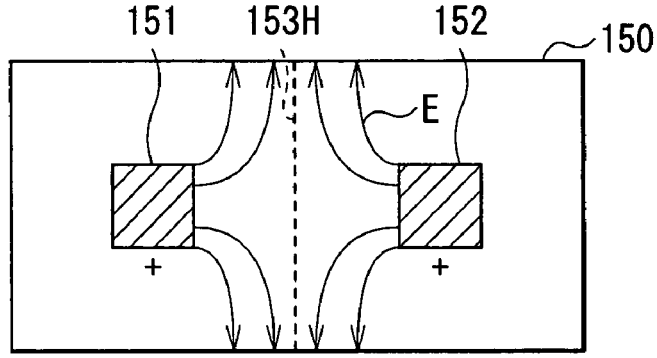

FIG. 8A illustrates a distribution of the electric field E in the odd mode of the coupling transmission line, and FIG. 8B illustrates a distribution of the electric field E in the even mode. In FIGS. 8A and 8B, a ground layer 150 is formed at a peripheral portion, and conductor lines 151 and 152 of bilateral symmetry are formed in the inside. FIGS. 8A and 8B illustrate electric field distributions within a cross section orthogonal to a transmission direction of the coupling transmission line, and the direction of transmission of a signal is orthogonal to the drawing surface.

Figure 9A:
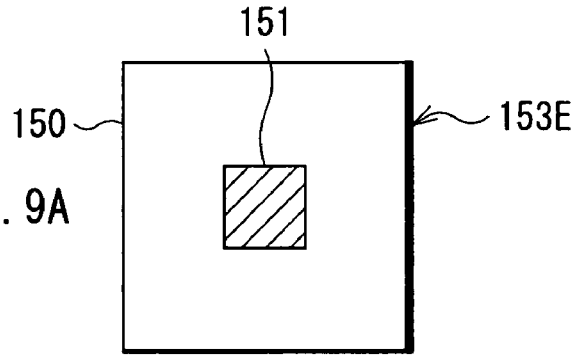
FIGS. 9A and 9B are explanatory drawings illustrating an odd mode and an even mode, respectively, in the structure of a transmission line equivalent to the coupling transmission line of bilateral symmetry.

As illustrated in FIG. 8A, in the odd mode, the electric fields cross perpendicularly with respect to a symmetrical plane of the conductor lines 151 and 152, and the symmetrical plane becomes a virtual electrical wall 153E. FIG. 9A illustrates a transmission line equivalent to that in FIG. 8A. As illustrated in FIG. 9A, a structure equivalent to the line composed only of the conductor line 151 can be obtained by replacing the symmetrical plane with the actual electrical wall 153E (a wall of zero potential, or a ground). The characteristic impedance by the line illustrated in FIG. 9A becomes a characteristic impedance $Z_0$ in the odd mode in the above-mentioned equations (1A) and (1B).

Figure 9B:
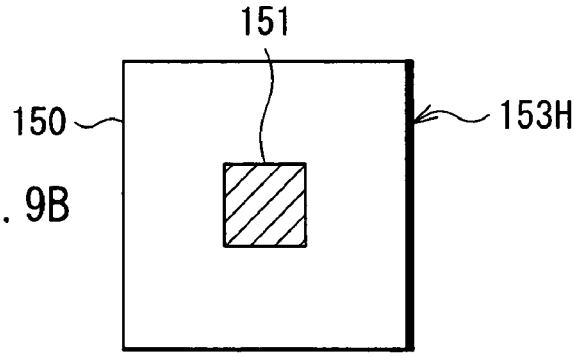

On the other hand, in the even mode, the electric fields are balanced with respect to a symmetrical plane of the conductor lines 151 and 152, as illustrated in FIG. 8B, so that the magnetic fields cross perpendicularly with respect to the symmetrical plane. In the even mode, the symmetrical plane becomes a virtual magnetic wall 153H. FIG. 9B illustrates a transmission line equivalent to that in FIG. 8B. As illustrated in FIG. 9B, a structure equivalent to the line composed only of the conductor line 151 can be obtained by replacing the symmetrical plane with the actual magnetic wall 153H (a wall whose impedance is infinity). The characteristic impedance by the line illustrated in FIG. 9B becomes a characteristic impedance $Z_e$ in the even mode in the above-mentioned equations (1A) and (1B).

In general, a characteristic impedance Z of a transmission line can be expressed by a ratio of a capacity C with respect to a ground per unit length of a signal line, and an inductance component L per unit length of a signal line. That is, $$Z=\sqrt{(L/C)} \quad (2)$$

where √ indicates a square root of the entire (L/C).

In the characteristic impedance $Z_o$ in the odd mode, the symmetrical plane becomes a ground (the electric wall 153E) from the line structure of FIG. 9A, and the capacity C with respect to the ground is increased. Hence, from the equation (2), the value of $Z_o$ is decreased. On the other hand, in the characteristic impedance $Z_e$ in the even mode, the symmetrical plane becomes the magnetic wall 153H from the line structure of FIG. 9B, and the capacity C is decreased. Hence, from the equation (2), the value of $Z_e$ is increased.

Taking the above-described matter into account, consider now the equations (1A) and (1B), which are the resonance frequencies of the resonance modes of the pair of interdigital coupled quarter-wave resonators 21 and 31. Since the function of an arc tangent is a monotone increase function, the resonance frequency increases with an increase in a portion regarding $\tan^{-1}$ in the equations (1A) and (1B), and decreases with a decrease in the portion. That is, the value of the characteristic impedance $Z_o$ in the odd mode is decreased, and the value of the characteristic impedance $Z_e$ in the even mode is increased. As the difference therebetween increases, the resonance frequency $f_1$ of the first resonance mode increases from the equation (1A), and the resonance frequency $f_2$ of the second resonance mode decreases from the equation (1B).

Accordingly, by increasing the ratio of the symmetrical plane of transmission paths to be coupled, the first resonance frequency $f_1$ and the second resonance frequency $f_2$ depart from each other, as illustrated in FIG. 10. FIG. 10 illustrates a distribution state of resonance frequencies in the pair of interdigital coupled quarter-wave resonators 21 and 31. An intermediate resonance frequency $f_o$ of the first resonance frequency $f_1$ and the second resonance frequency $f_2$ is a frequency in the resonance at a quarter-wave determined by the physical length of a line (i.e. a resonance frequency in each of the quarter-wave resonators when no interdigital coupling is established). Here, increasing the ratio of the symmetrical plane of the transmission paths corresponds to increasing the capacity C in the odd mode from the equation (2). Increasing the capacity C corresponds to enhancing the degree of coupling of a line. Therefore, in the pair of interdigital coupled quarter-wave resonators 21 and 31, a stronger coupling between the resonators causes further separation between the first resonance frequency $f_1$ and the second resonance frequency $f_2$.

The strong coupling between the pair of quarter-wave resonators 21 and 31 of interdigital type provides the following advantages. That is, the resonance frequency $f_0$ determined by the physical length of a quarter-wave can be divided into two. Specifically, there occur a first resonance mode that resonates at a first resonance frequency $f_1$ higher than the resonance frequency $f_0$, and a second resonance mode that resonates at a second resonance frequency $f_2$ lower than the resonance frequency $f_0$.

In this case, by setting the second resonance frequency $f_2$ of the low frequency as an operating frequency (a passing frequency if configured as a filter), there is a first advantage of further reducing the dimension of the entire resonator than the case of setting the operating frequency to the resonance frequency $f_0$. For example, when a filter is designed by setting 2.4 GHz band as a passing frequency, it is possible to use a quarter-wave resonator whose physical length corresponds to 8 GHz, for example. This is smaller than the quarter-wave resonator whose physical length corresponds to 2.4 GHz band.

A second advantage is that conductor loss can be reduced. FIGS. 11A and 11B illustrate schematically a distribution of a magnetic field H in the pair of interdigital coupled quarter-wave resonators 21 and 31. Specifically, FIGS. 11A and 11B illustrate magnetic field distributions within a cross section orthogonal to the direction of flow of the current i in the second resonance mode in the pair of quarter-wave resonators 21 and 31 as illustrated in FIG. 7. The direction of flow of the current i is a direction orthogonal to the drawing surface. In the second resonance mode, as illustrated in FIG. 11A, the magnetic field H is distributed in the same direction (for example, in a counterclockwise direction) within the cross section in the pair of quarter-wave resonators 21 and 31. In this case, when these resonators are strongly interdigital coupled to each other (the pair of quarter-wave resonators 21 and 31 are brought into closer relationship), this leads to a magnetic field distribution equivalent to a state where the pair of quarter-wave resonators 21 and 31 are virtually regarded as a conductor, as illustrated in FIG. 11B. That is, the conductor thickness can be increased virtually, thereby reducing the conductor loss.

As discussed above, firstly, the present embodiment facilitates miniaturization by configuring the respective resonant sections 11, 12, 13 and 14 with the plurality of stacked interdigital coupled quarter-wave resonators. Secondly, the first and the second resonators 41 and 51 are arranged so as to be electromagnetically coupled to the resonant sections 11 and 14 at the opposite ends, respectively, so that the physical length thereof is longer than that of the plurality of interdigital coupled quarter-wave resonators. This enables the first and second resonators 41 and 51 to have higher impedance than the resonant sections having the interdigital coupling structure, making it easy to obtain impedance matching with the external circuits in the broad band. These enable miniaturization and sufficient impedance matching with the external circuits in the broad band, resulting in excellent filter characteristics in the broad band.

Modifications

Modifications of the stacked filter of the present embodiment will be described below. In the following modifications, those parts corresponding to the configuration as shown in FIGS. 1 to 3, 4A to 4F and 5 are identified with the same numerals.

[First Modification]

Figure 14A:
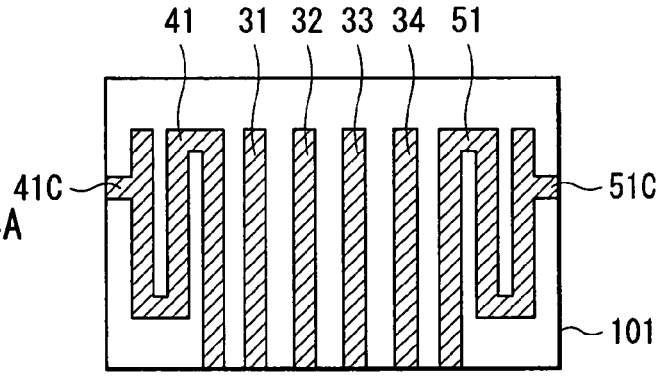
FIGS. 14A and 14B are diagrams illustrating a key part configuration of a first modification of the abovementioned stacked filter, respectively.
Figure 14B:
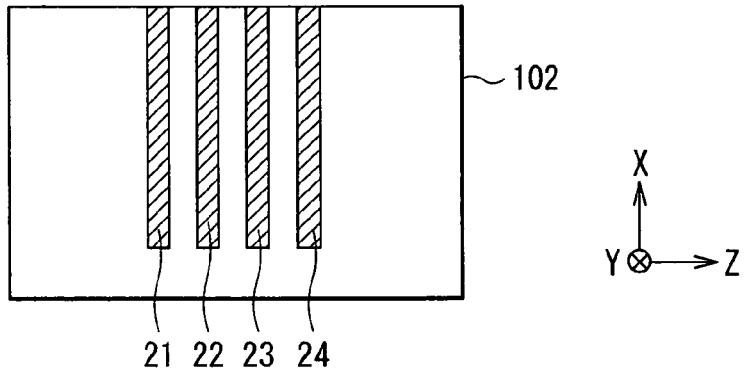

FIGS. 14A and 14B illustrate a first modification of the stacked filter. In the first modification, the abovementioned line conductor layers in FIGS. 4C and 4D are replaced with those in FIGS. 14A and 14B, respectively. In the structure of FIGS. 4C and 4D, the first and second resonators 41 and 51 are formed separately in the two stacked surfaces 101 and 102, respectively. In the first modification, the first and second resonators 41 and 51 are formed as a continuous line conductor only in the stacked surface 101. That is, the first resonator 41 is formed adjacent the quarter-wave resonator 31 constituting the resonant section 11 on a first end side in the stacked surface 101. The second resonator 51 is formed adjacent the quarter-wave resonator 34 constituting the resonant section 14 on a second end side in the stacked surface 101.

[Second Modification]

Figure 15A:
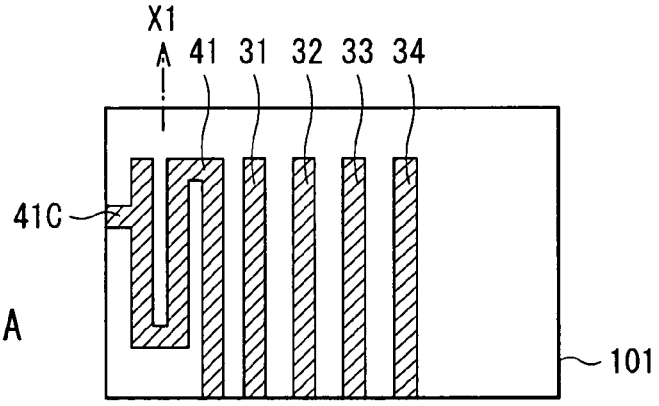
FIGS. 15A and 15B are diagrams illustrating a key part configuration of a second modification of the abovementioned stacked filter, respectively.
Figure 15B:
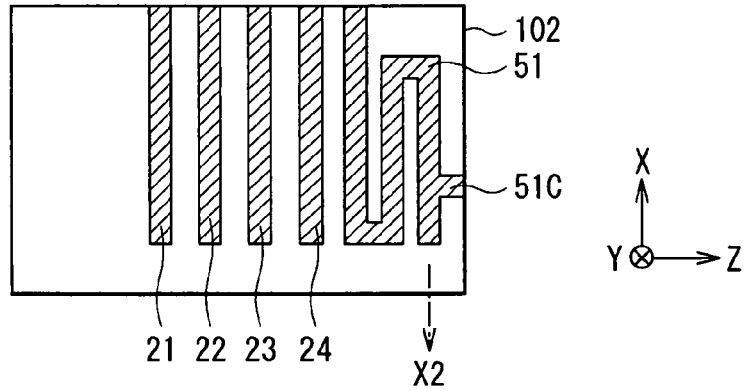
Figures 16A, 16B, 16C, 16D, 16E, 16F:
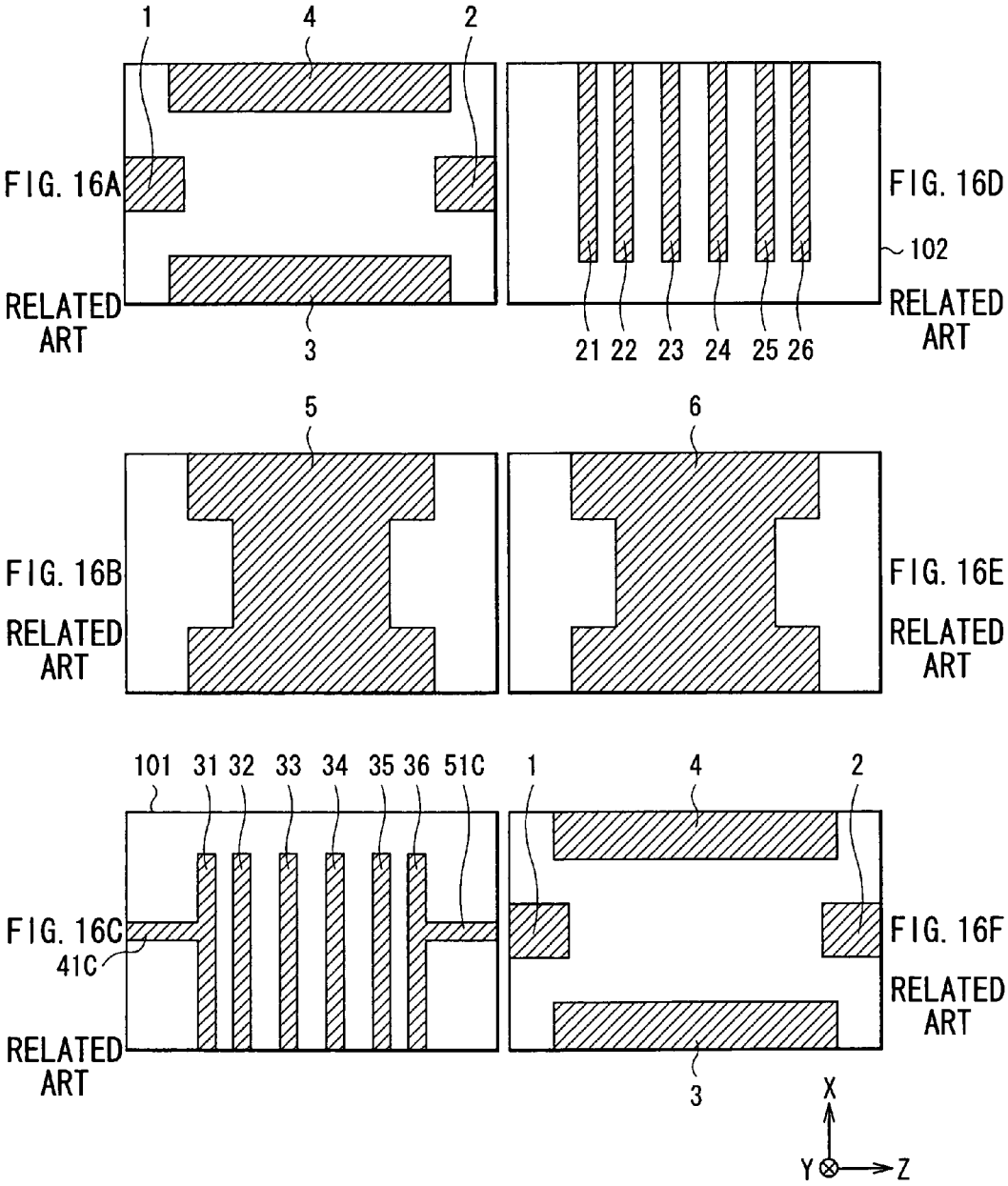
FIG. 16A RELATED ART
FIG. 16D RELATED ART
FIG. 16B RELATED ART
FIG. 16E RELATED ART
FIG. 16F RELATED ART
FIGS. 16A to 16F are diagrams illustrating the plane configurations of individual layers in the stacked filter of the comparative examples, respectively.

FIGS. 15A and 15B illustrate a second modification of the stacked filter. In the first modification, the first and second resonators 41 and 51 are formed as a continuous line conductor in the stacked surface 101. In the second modification, the first and second resonators 41 and 51 are formed as a continuous line conductor in the individual stacked surfaces 101 and 102, respectively. That is, the first resonator 41 is formed adjacent the quarter-wave resonator 31 constituting the resonant section 11 on a first end side in the stacked surface 101. The second resonator 51 is formed adjacent the quarter-wave resonator 24 constituting the resonant section 14 on a second end side in the stacked surface 102. Like the structure in FIGS. 4C and 4D, the first and second resonators 41 and 51 in the structure of the second modification are connected to the external terminal electrodes 1 and 2 for signals from different internal layer sides, respectively. Additionally, like the structure in FIGS. 4C and 4D, the open ends of the first and second resonators 41 and 51 are oriented in the reverse direction.

[Other Modification]

The present invention is not limited to the above preferred embodiment and modifications, and other modifications are applicable. The foregoing description has been made of the case where the respective resonant sections 11, 12, . . . 1*n* are interdigital coupled by using the two quarter-wave resonators 2*n* and 3*n*, as a group. Alternatively, the respective resonant sections 11, 12, . . . 1*n* may have three or more quarter-wave resonators to obtain a structure having two or more groups of interdigital coupled resonators.

It should be understood by those skilled in the art that various modifications, combinations, sub-combinations and alterations may occur depending on design requirements and other factors insofar as they are within the scope of the appended claims or the equivalents thereof.

What is claimed is:

1. A stacked filter comprising:

an array of more than two resonant sections arranged parallel in a stack plane direction, the resonant sections adjacent each other being electromagnetically coupled; and a first resonator electromagnetically coupled to the resonant section on one end of the array of the resonant sections, and a second resonator electromagnetically coupled to the resonant section on the other end thereof, wherein each of the resonant sections has a plurality of quarter-wave resonators facing each other in a stacking direction, and the quarter-wave resonators facing each other are interdigital coupled to each other, so that a passing frequency as a filter is set to a value $f_2$ lower than a frequency $f_0$ determined by a physical length $\lambda_0/4$ of the quarter-wave resonator, and the first and the second resonators have a physical length of $\lambda_2/4$, where $\lambda_2$ is a wavelength corresponding to the passing frequency $f_2$.

2. The stacked filter according to claim 1, wherein each of the first and the second resonators has a plurality of line conductors arranged in the stacking direction and a connection conductor completing continuity between the plurality of line conductors, a whole length of the line conductors and the connection conductor being $\lambda_2/4$.

3. The stacked filter according to claim 1, further comprising:

a couple of leading conductors each causing the first or the second resonator to be in continuity with an external terminal electrode.

4. The stacked filter according to claim 1, wherein each of the first and the second resonators has one end as an open end and the other end as a short-circuit end, the open end of the first resonator and the open end of the second resonator being oriented in reverse direction.

* * * * *